United States Patent [19]

Sapp et al.

[11] 4,068,599

[45] * Jan. 17, 1978

[54] UNITIZING FRAME FOR A PALLET

[76] Inventors: Lawrence G. Sapp, 621 Lone Palm Drive; James F. Slappey, Tillman Road, both of Lakeland, Fla. 33801; C. Bart Nixon, 125 NW. 15th St., Oklahoma City, Okla. 73103

[ * ] Notice: The portion of the term of this patent subsequent to June 7, 1994, has been disclaimed.

[21] Appl. No.: 725,452

[22] Filed: Sept. 22, 1976

Related U.S. Application Data

[63] Continuation-in-part of Ser. No. 624,888, Oct. 22, 1975, Pat. No. 4,027,599.

[51] Int. Cl.[2] ..... B65D 19/44

[52] U.S. Cl. ..... 108/55.1; 403/353

[58] Field of Search ..... 108/53.1, 53.5, 55.1, 108/56.1; 211/189, 191, 182; 214/10.5 R; 403/292, 319, 353

[56] References Cited

U.S. PATENT DOCUMENTS

| | | | |
|---|---|---|---|
| 534,507 | 2/1895 | Hoagland | 403/353 |
| 730,186 | 6/1903 | Case | 403/353 |
| 2,988,313 | 6/1961 | Ellison | 108/53.5 |
| 3,091,195 | 5/1963 | Kenyon et al. | 108/53.5 |
| 3,168,060 | 2/1965 | Farley | 108/53.5 |
| 3,277,848 | 10/1966 | Runge et al. | 108/55.1 |
| 3,289,613 | 12/1966 | Evans | 108/53.5 |
| 3,529,857 | 9/1970 | Dalton et al. | 211/182 X |
| 4,027,599 | 6/1977 | Sapp et al. | 108/55.1 |

FOREIGN PATENT DOCUMENTS

| | | | |
|---|---|---|---|
| 114,048 | 5/1969 | Denmark | 108/55.1 |
| 1,089,616 | 3/1955 | France | 108/53.5 |
| 1,357,458 | 2/1964 | France | 108/55.1 |
| 1,506,844 | 8/1969 | Germany | 108/53.5 |
| 560,750 | 4/1957 | Italy | 403/353 |
| 369,404 | 6/1963 | Switzerland | 108/55.1 |
| 708,243 | 5/1954 | United Kingdom | 108/55.1 |

*Primary Examiner*—Roy D. Frazier
*Assistant Examiner*—William E. Lyddane
*Attorney, Agent, or Firm*—Finnegan, Henderson, Farabow & Garrett

[57] ABSTRACT

A unitizing frame for a pallet, which can be quickly assembled and disassembled from the pallet, utilizing a pair of like panels having a width substantially equal to the lateral dimension of the pallet, the panels being fabricated of square tube stock and including hollow side frame members extending the length of the panel. A pair of panel support bars, of length equal to the other dimension of the pallet, has integral laterally extending plates for frictional engagement with upper and lower surfaces of structural components of the pallet when the bar is manually applied to the side of the pallet. A pair of the plates on the upper ends of the bars has welded thereto upstanding elements for removably interlocking with the lower ends of opposing side frame members for unassistedly holding the panels upright. Rod members, having downwardly turned ends, cross-brace the tops of the frames by insertion of the downwardly turned ends into the hollow tops or into slots in the sides, of opposing side frame members. Additional cross-brace rods may have their down-turned ends inserted into opposed slots spaced along the side frame members. The unitizing frame is particularly useful with a wood pallet, such as the standard 48 × 40 inch four-way entry wood pallet used for transporting case goods in the grocery industry, wherein the unitizing frame does not impede access to the four-way entry by a pallet jack or fork lift truck.

9 Claims, 6 Drawing Figures

UNITIZING FRAME FOR A PALLET

This application is a continuation-in-part of application Ser. No. 624,888 filed Oct. 22, 1975, now U.S. Pat. No. 4,027,599, in the name of the inventors hereof.

BACKGROUND OF THE INVENTION

1. Field of the Invention

This invention relates to a unitizing frame for a pallet and more particularly to a unitizing frame for a four-way wood pallet such as that used for transporting cartons and case goods in the grocery industry.

2. Prior Art

In the highly mechanized grocery industry case goods are placed on standard wooden pallets by the distributor, transported by truck while on the pallet, and delivered to the retail grocer on the pallet. During the transportation, however, there is a tendency for the case goods to shift about on the pallet. At least the integrity of the pallet may be lost, and often the goods are damaged in transit. Upon the unloading of the truck, therefore, it is necessary at least to restack the case goods before the pallet can be removed from the truck. If goods are damaged, there is additional cost in time and replacement. In a recent study by the National American Wholesale Grocers Association, as to cases of merchandise damaged when delivered to the warehouse, while in and during delivery to the retail outlet, 42% were damaged between the warehouse and the customer outlet.

A necessity has therefore arisen for a unitizing frame for temporary attachment to each pallet for holding cartons and case goods in a unitized relationship during the transportation of the pallets.

Such unitizing frames are known in the industry. However, the unitizing frames of the prior art have several distinct disadvantages. There has been a tendency in the past to build into the frame the strength necessary for stacking the pallets and frames one on top of the other for use in warehousing. This has necessitated a much heavier frame than would be necessary for unitizing the case goods in transport only. When such frames are also used for warehousing it has often been necessary that part of the frame fold down so that access can be had to the cartons inside the frame.

The frames of the prior art have often had to be attached to the pallet, as by nailing, to secure stability. They have obstructed access to the four-way pallet, at least on the sides, by the pallet jacks or fork lift trucks, used in the warehouse, or in the loading and unloading of the pallets.

In filling orders for retail outlets, the pallet is moved endwise through the aisles of the warehouse and filled from the sides. The loaded pallets are then positioned in a truck for transportation, part of the pallets being parallel to the side walls of the truck and part parallel with the ends of the truck. It is necessary, therefore, that the pallet be accessible both from the ends, i.e. on the lateral dimension, and from the sides, by a pallet jack or fork lift truck for movement from the warehouse into a truck.

The grocery industry has agreed upon a standard 48 × 40 inches four-way wood pallet in which the ends are open and the side stringers have aligned cutaway areas for access by pallet jacks or fork lift trucks.

It is desirable that the unitizing frame be so constructed that it can be quickly assembled on the pallet and disassembled from the pallet by one person without undue strain and that the frame not interfere with the loading of the pallet from both sides. The frame should interlock on the pallet for stability, but should be easily disassembled and removed from the pallet, before the pallet is unloaded, for return to the warehouse with the truck.

The components of the disassembled pallet should stack flat for easy transport, and for requiring minimum space when the unitizing frames are being returned from the retail store to the distributor and when not in use at the warehouse of the distributor. Preferably, a group of disassembled frames should stack quickly into a frame assembled on a pallet for quick transport and storage.

SUMMARY OF THE INVENTION

Accordingly, it is the primary object of this invention to improve unitizing frames used for the four-way wood pallets in the grocery industry for stacking and controlling damage of products during transport from one point to another.

It is also an object of this invention to provide a unitizing frame which can be quickly assembled and disassembled from the pallet.

It is a further object of this invention to provide a frame which can be easily assembled and disassembled by one person.

It is a still further object of this invention to fabricate the component parts of a unitizing frame of a pallet such that they will stack flat when disassembled.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and, in accordance with the purpose of the invention, as embodied and broadly described herein, there is provided a unitizing frame for a four-way pallet utilizing a pair of like panels having a width substantially equal to the lateral dimension of the pallet, the pallets including hollow side frame members extending the length of the pallet, means for unassistedly supporting the panels vertically on the pallet, the supporting means including a plurality of planar members for frictionally engaging upper and lower surfaces of structural components of the pallet and means for stably engaging the lower ends of the side frame members, and at least one pair of rod members for disengagingly interlocking each side frame member of one of said pair of panels to the opposing side frame member of the other of the panels when the panels are held vertically on the pallet by the supporting means.

Preferably the supporting means comprise a pair of bars each having a length substantially equal to the length of the pallet, each bar having a plurality of planar members extending laterally and inwardly over upper and lower surfaces of structural members of the pallet, the bars including an upper plate at each end of each bar, a side of the upper plate being substantially flush with the end of the pallet and at least a pair of lower plates integral with the bar and extending inwardly of the pallet in frictional engagement with the upper surface of the aligned cutaway portions of the stringers of the pallet.

It is also preferred that the side frame members are tubular and that the means for stably engaging the side frame members includes a socket having a half-open upstanding portion integral with each of the upper plates, the half-open portion being complementary in shape to the outer surface of the tubular side frame member and facing outwardly from the end of the bar for receiving the lower end of the side frame member. A stud is affixed in the half-open portion for insertion in an aperture in the side frame member as the lower ends of the side frame members are inserted into the sockets while canting the panel outwardly, and then straightening the panel to the vertical.

Further, the unitizing frame as embodied herein, includes a plurality of shaped apertures spaced along the length of the side members for the receipt of additional cross-bracing rod members as may be desired.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings.

Figure 1:
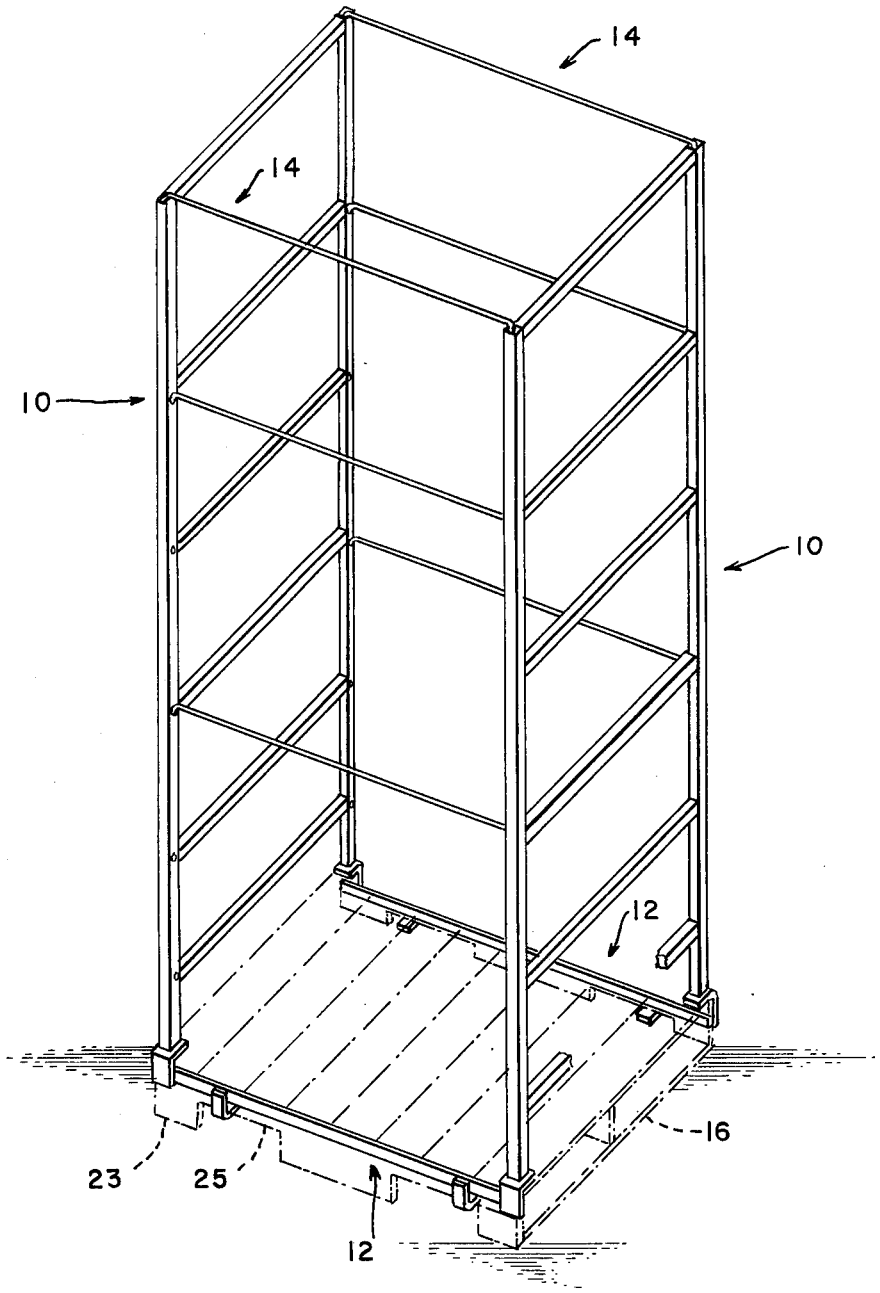
FIG. 1 is a perspective view of one embodiment of the unitizing frame of the invention assembled on a four-way wood pallet.
Figure 2:
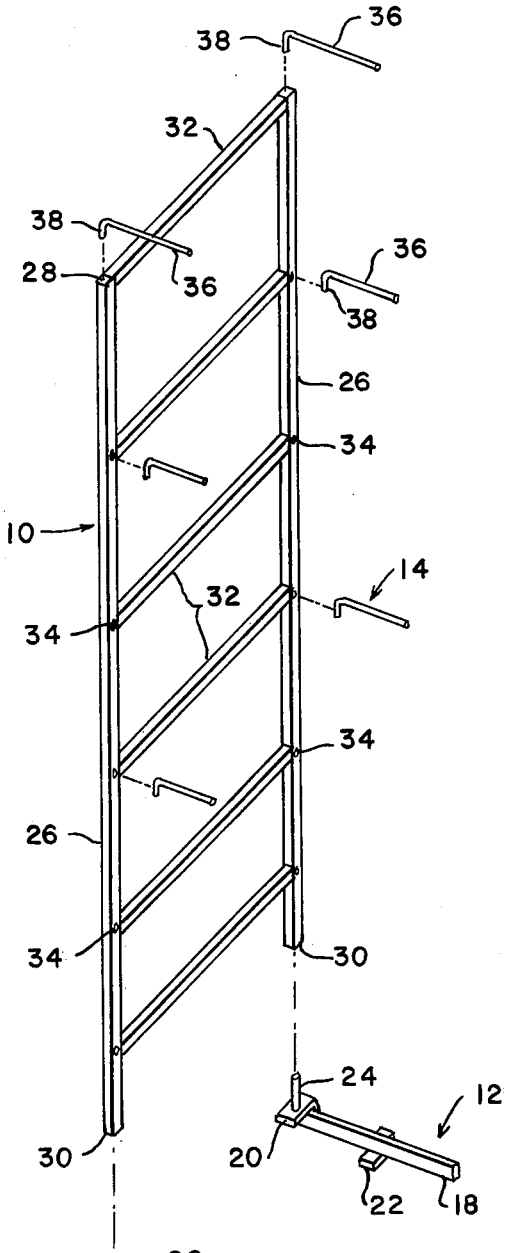
FIG. 2 is an exploded perspective view of one end of the unitizing frame of FIG. 1 looking outwardly from the inside of the frame.

Referring now to FIGS. 1 and 2, in accordance with the invention, it may be seen that the unitizing frame of the invention includes a pair of like panels 10, a pair of support base 12, and at least one pair of rod members 14 for assembly on the pallet 16. Each panel 10 has a width equal to the lateral dimension of the pallet 16 and the support bar 12 has a length equal to the other dimension of the pallet 16. The rod members 14 disengagingly interlock opposing side members of the panels 10. The support bars 12 unassistedly support the panels 10 in an upright position.

As embodied herein, each support bar 12 extends the length of the pallet 16 having a main body portion 18 and including at least a pair of laterally extending upper plates 20 one at each end of each bar, for frictionally engaging the upper surface of the pallet. At least a pair of laterally extending lower plates 22, integral with the bar 12 extend inwardly of the pallet 16 for engaging the lower surface of a structural component of the pallet. Preferably the lower plates 22 are spaced along the main body portion 18 of the support bar 12 intermediate the upper plates 20.

In the embodiment, as shown in FIGS. 1 and 2, the unitizing frame of the invention is particularly adapted to the four-way wood pallet utilized by the grocery industry in which the length of the pallet 16 is supported by a stringer 23 having carved out portions 25 on the lower surface thereof. The lower plate members 22 frictionally engage the lower surface of the stringer 23 on the upper surface of the carved out area, while not impeding access to the carved out areas by a pallet jack or fork lift truck.

Preferably the plate members 20, 22 are angle irons, the elongated bar 12 is a solid bar and the plate members are welded to the bar.

Figure 3:
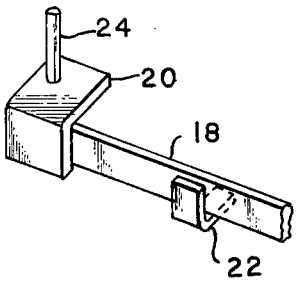
FIG. 3 is a detailed view of one end of the support bar of the embodiment of FIG. 1.

In accordance with the invention, in the embodiment illustrated in FIGS. 1–3, stud members 24 are welded to the upper surface of the upper plate members 20 for interacting with and supporting the panels 10.

In accordance with the invention, the panels 10 include side members 26 fabricated of hollow square tubing and having apertures 28 at their upper ends and apertures 30 (not shown) at the lower ends. Preferably the side members 26 are formed of $1\frac{1}{4}$ in. square tube stock and the studs 24 are shaped for insertion in the apertures 30 in a snug fit. However, the studs 24 should be sized such that they can be inserted and withdrawn from the side members 26 without strenuous effect by one person.

As embodied herein, the panels 10 extend across the shorter lateral dimension of the pallet 16 and the support bars 12 extend along the longer dimension of the pallet 16. Therefore the panels 10 are supported at one end by one support bar 12 and at the other end by the other support bar 12.

As embodied herein, the panels 10 also include parallel cross members 32 rigidly affixed to the side frame members 26. Preferably the cross members 32 are fabricated of the same square tube stock as the side frame members 26 and are welded thereto.

In accordance with the invention, the rod members 14 are substantially of the same length as the support bars 12 and include a main body portion 36 and relatively short bent portions 38 substantially perpendicular to the body portion 36. The rod members 14 are preferably fabricated of $\frac{1}{2}$ in. solid steel rods and the bent down portions 38 are inserted in the apertures 28 at the upper ends of opposed side members 26 of the panels 10.

As embodied herein, a plurality of apertures 34 is spaced along the length of each side member 26, the apertures 34 being shaped to receive the bent down portions 38 of additional pairs of rod members 14 as may be necessary or desirable in unitizing the pallet for specific types of cartons or case goods. Preferably, the apertures 34 are positioned near the end of the cross members 32.

Figure 5:
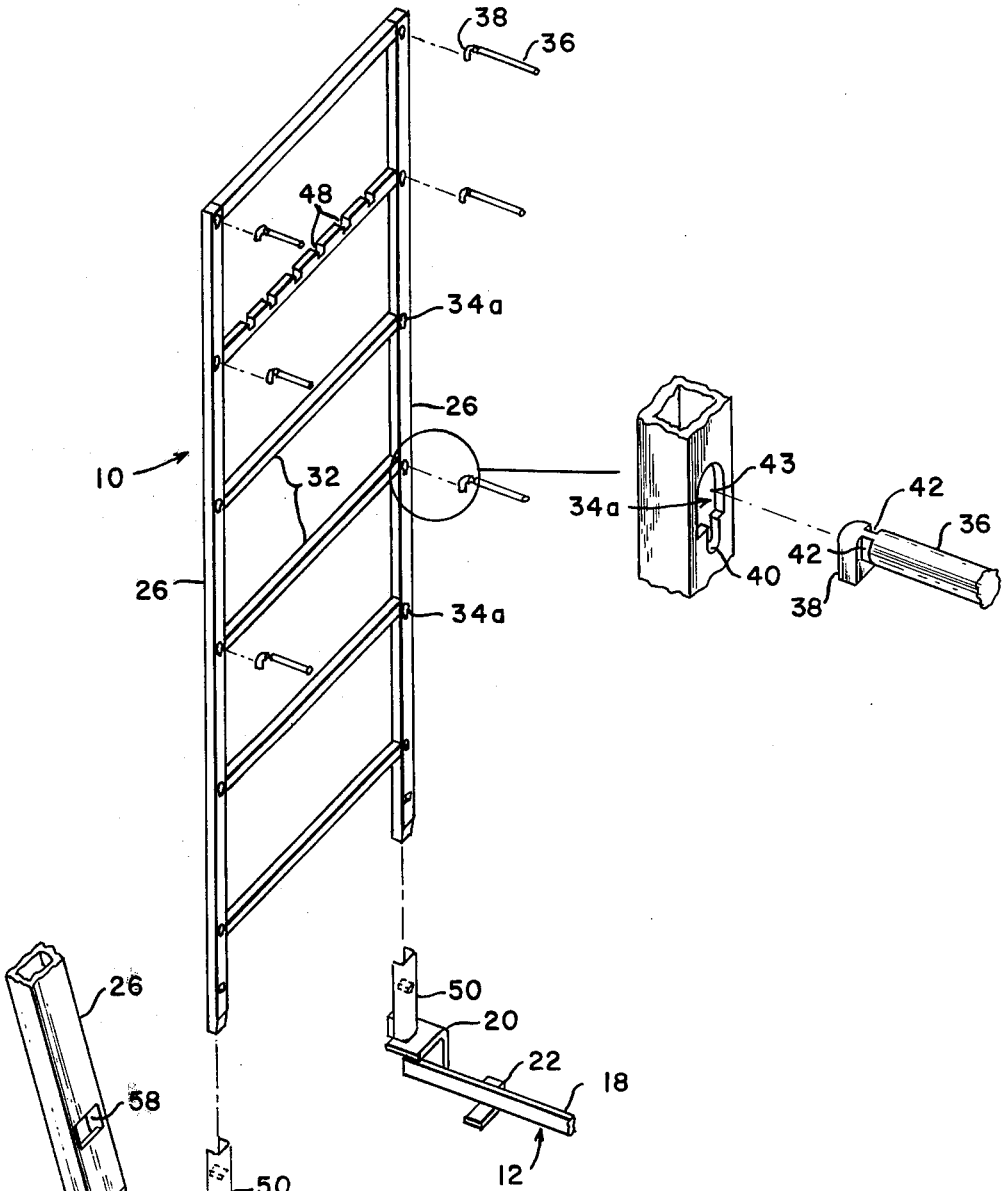
FIG. 5 is an exploded perspective view of one end of the unitizing frame of FIG. 4 looking outwardly through the end of the frame.

As shown in FIG. 5, the apertures spaced along the side members 26 are specially shaped, as in **34*a*, to have a restricted key slot 40 at the lower end. The rod members 14 are formed with a pair of channels 42, one on each side of the rod member between the short been portion 38 and the body 36 of the rod. The apertures 34*a* and the ends of the rod members 14 are so sized that the bent portion 38 may be inserted in the larger upper portion 43 of the aperture 34*a* and then locked into the aperture by pressing the channeled portion of the rod member into the slot 40**.

It is preferred that all of the rod members 14, including the uppermost rods, be so interconnected with the side frame members 26, as shown in FIG. 5.

As will be seen, the unitizing frame of the invention comprises only three component parts: the panels 10, the support bars 12 and the rod members 14 which may be assembled quickly on the pallet 16. The support bars 12 slide over the sides of the stringers 23 of the four-way pallet and the studs 24 of this embodiment support the panels 10 unassistedly in an upright position so that the unitizing frame can be assembled without difficulty by one person. In the frame of the invention, no cases of materials are stacked on the support bars 12 and the panels 10 and rod members 14 do not support any contents of the pallet.

Additional rod members 14 may be inserted between the side frame members 26, as desired, as the case load of the pallet rises and the additional rod members 14 do not interfere with the loading of the pallet from the sides.

The unitizing frame controls the position of the top layers of cases on the pallet and the center of gravity of the load is maintained on the center of the pallet.

When the loaded pallet is delivered to the customer, the rod members may be removed, the side panels dismounted from support bars and the support bars disengaged from the pallet while leaving the cases of material undisturbed on the pallet for later distribution, for example, to shelves. The disassembled frame, however, can be returned to the warehouse with the transport truck.

The loaded pallet can be delivered to the customer, the frame removed from the pallet and returned to the transport truck in one trip into the customer's delivery area. The turn-around time for the transport truck is therefore much less than that in which cased material is delivered in carts and unloaded before the truck can return to the warehouse.

Preferably, in accordance with the invention, the elements of the disassembled frame can be stacked conveniently in a frame assembled on a pallet.

Figure 6:
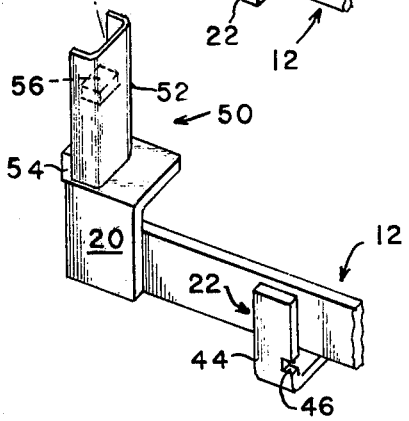
FIG. 6 is a detailed view of one end of the support bar of the embodiment of FIG. 4 and the cooperating end of the side frame member.

As embodied herein, and shown in FIG. 6, the lower plate members 22, welded to the body portion 18 of the support bars 12, may be fabricated with a short shank portion 44 extending downwardly from the bar 12. For purposes of transporting the disassembled frames, a notch 46 can be cut in the inward portion of the shank 44 for interlocking with one of a series of spaced slots 48 cut in the upper surface of one of the parallel cross members 32. The selected cross member 32 containing the slots 48 should be toward the upper end of the panel 10 to support the full length of the support bars 12.

The frames utilized with a loaded transport truck can, when disassembled, be stacked in not more than two framed pallets.

Figure 4:
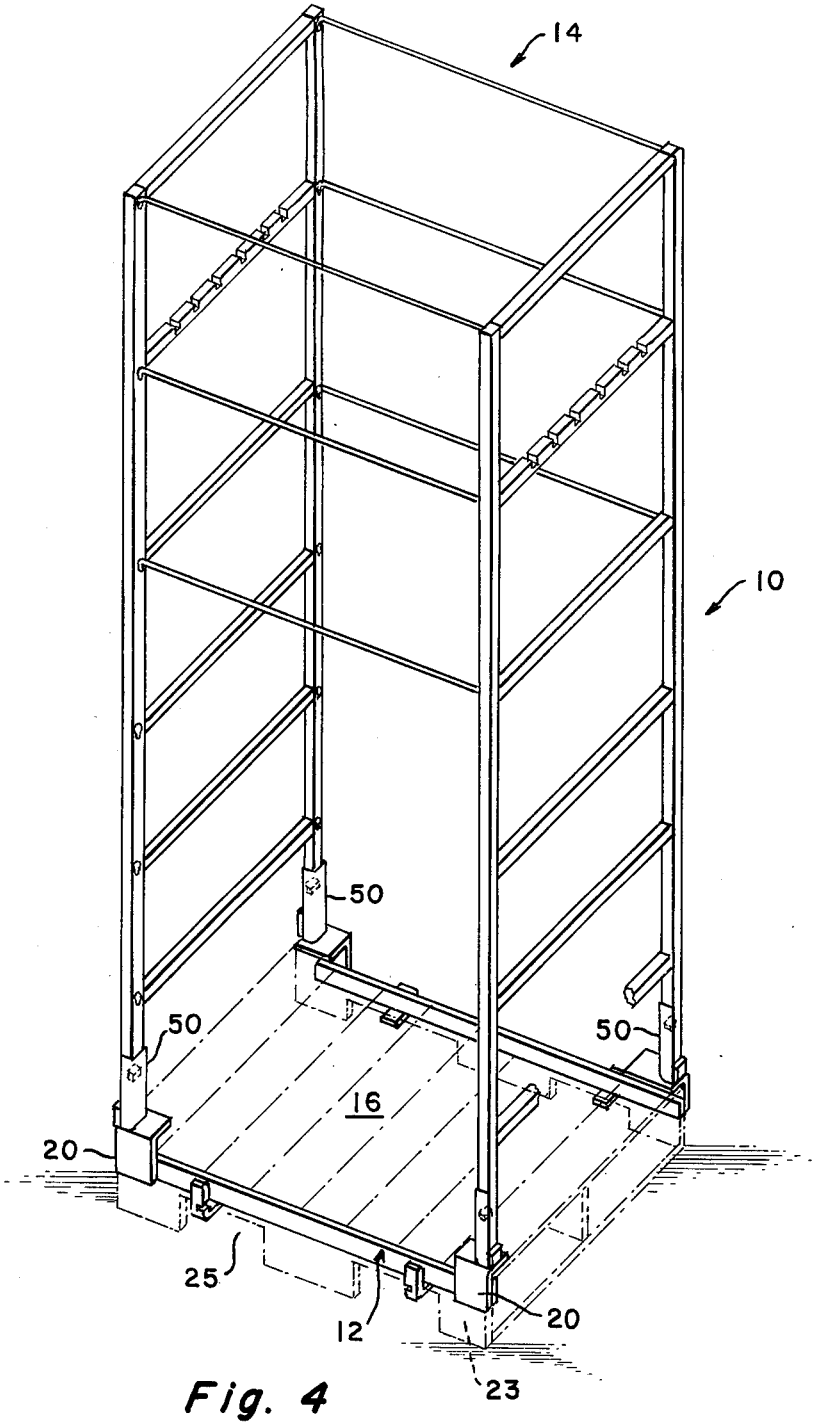
FIG. 4 is a perspective view of a second embodiment of the unitizing frame of the invention assembled on a four-way pallet.

In accordance with the invention, a second preferred embodiment is illustrated in FIGS. 4–6 as to means for stably engaging the panels 10 with the support bars 12 and for preventing accidental disengagement of the panels.

Sockets 50 are individually welded to the upper surfaces of the upper plates 20 at the ends of the support bars 12. The sockets 50 are sized to receive therein the lower ends of the side members 26.

Each of the sockets 50 includes a "half-open" upstanding member 52 (FIG. 6) of U-shaped cross section for partially encompassing the lower end of a side member 26, the upstanding member 52 having its lower end welded to the plate 20. The upstanding member 52 is oriented with the open side of the U-shaped cross section proximate the end of the support bar 12.

A foot bar 54 is welded, or otherwise permanently affixed, across the open face of the upstanding member 52 near the plate 20 and substantially aligned with the end of the support bar 12. The lower end of the side member 26 fits snugly in the socket 50 between the upstanding member 52 and the foot bar 54.

The socket 50 also includes a stud 56, preferably of rectangular cross section, extending partially across the inner area of the upstanding member 52 and centrally positioned as to the width of the member 52. The stud 56 is inserted into an aperture 58 formed in the surface of the side member 26 when the side member 26 is inserted in the socket 50.

As embodied herein, the inner side of the lower end of the side member 26 is cut away to form a bevel 60.

In assembling the panel 10 on the support bars 12, the upper end of the panel 12 is canted outwardly from the pallet 16. The bevel 60 on each of the side members 26 is inserted into its respective socket between the stud 56 and the foot bar 54. The panel 10 is then rotated to the vertical position inserting the stud 56 into the aperture 58.

The panel 10 thus stands vertically without other external support. When both panels 10 have been assembled on the support bars 12 and a rod member 14 for each side of the frame interconnected to the side members 26 of the panels 10, a rigid unitizing frame is formed on the pallet 16.

Due to the interaction of the stud 52 with the aperture 58, the panels 10 are prevented from being accidentally disengaged from the support bars 12 when the frame is assembed on the pallet.

In the disassembly of the frame, after the removal of the rod members 12, the panels 10 remain standing. The panels 10 are rotated outwardly, about the lower ends of the side members 26, removing the studs 56 from the apertures 58 without disturbing the cased material on the pallet 16. As in the first embodiment, the support bars 12 can then be detached from the pallet.

In the utilization of the unitizing frame of the invention, transit damage to cartons of merchandise on the pallet has been greatly reduced, even though the pallet load contains cartons of differing sizes.

The unitizing frame of the invention has been found to be very useful, not only for warehouse loading and customer unloading on the customer premises but also for operations in the transports truck itself. For example, in the delivery of an order of less size than a pallet load, the panel 10 can be removed, after releasing the rod members 14, and cases of merchandise removed from the pallet, without otherwise having to move the pallet itself.

It will be apparent to those skilled in the art that various modifications and variations could be made in the unitizing frame of the invention without departing from the scope as defined in the claims.

What is claimed is:

1. A unitizing frame for a four-way entry pallet, the pallet having an upper surface and including a pair of stringers extending along the sides of the pallet, the stringers having aligned cutout portions in the lower surfaces thereof to provide the four-way entry, and said pallet having an open area across its lateral dimension between the stringers, the unitizing frame comprising:

a pair of like panels having a width substantially equal to the lateral dimension of the pallet, said panels including side members extending the length of the panel;

means for unassistedly supporting said panels vertically on said pallet without obstructing the open area, said supporting means including a pair of bars each having a length substantially equal to the length of the stringers and a plurality of planar members including an upper plate at each end of each bar integral with each said bar and extending inwardly over the upper surface of the pallet, a side of each upper plate being substantially flush with an end of the pallet, and at least a pair of lower plates integral with each said bar and extending inwardly of said pallet in individual frictional contact with a portion of the lower surfaces of the stringers above the cut-out portions and means on said upper plates for stably, but removably, engaging the lower ends of said side members, said engaging means including means for preventing accidental disengagement of said lower ends of said side members, and said pair of panels interlocking said bars on said pallet; and at least one pair of rod members for disengagingly interlocking each side member of one of said pair of panels to the opposing side member of the other of said panels when said panels are held vertically on said pallet by said pallet support means.

2. The unitizing frame of claim 1 wherein said side members of said panels are tubular and wherein said means for stably engaging said side members includes a socket integral with each of said upper plates and complementary in shape to the outer surface of said tubular side member for receiving the lower end of said tubular side member, and wherein said means for preventing accidental disengagement of said lower ends of said side members is automatically effective upon the receipt of the lower ends of said side members in said sockets.

3. The unitizing frame of claim 2 wherein each of said sockets includes an upstanding member of U-shaped cross section having its lower end integral with an upper plate, said upstanding member being oriented with the open face of said U-shaped cross section outward from the end of the bar integral therewith and a foot bar affixed across said open face near the lower end of said upstanding member.

4. The unitizing frame of claim 3 wherein said means for preventing accidental disengagement of said lower ends of said side members include a stud affixed to the inner wall of said upstanding member positioned above said foot bar and said lower end of each of said side members includes an aperture for receipt of said stud when said lower ends of said side members are inserted in said sockets.

5. The unitizing frame of claim 4 wherein the lower end of each of said side members below the aperture therein is beveled for insertion of said beveled end into said socket between said stud and said foot bar while said panel is canted outwardly from said pallet and said stud is locked into said aperture when said panel is rotated into a vertical position.

6. The unitizing frame of claim 1 wherein said side members of said panels includes a plurality of shaped apertures spaced along the length of the side members and wherein each of said rod members includes an elongated body portion and a relatively short end portion substantially perpendicular to said body portion, said end portions of a rod member being shaped for insertion into aligned ones of said shaped apertures.

7. The unitizing frame of claim 6 wherein said shaped apertures of said side members include a restricted key slot and wherein said rod members include a pair of parallel channels at the intersection of said body portion and said end portion for fitting into said key slot and interlocking said rod member with said side member.

8. The unitizing frame of claim 1 wherein said panels include a plurality of cross members having their ends rigidly affixed to said side members, a selected one of said cross members having a plurality of horizontal slots spaced across the width of its upper surface and wherein at least one of said lower plates integral with each of said bars includes a notch in the side thereof for interaction with one of said horizontal slots in said selected cross member for storage of the bar of a disassembled frame.

9. The unitizing frame of claim 1 wherein said four-way pallet is the standard four-way entry wood pallet adopted by the grocery industry, said panels being substantially 40 inches wide and said bars being substantially 48 inches long.

* * * * *